US008869943B2

(12) United States Patent
Matthews et al.

(10) Patent No.: US 8,869,943 B2
(45) Date of Patent: Oct. 28, 2014

(54) INFINITELY ADJUSTABLE AND CONSTRAINABLE MOVABLE STRUCTURE FOR A VEHICLE LIFT

(75) Inventors: Jason E. Matthews, Madison, IN (US); John G. Atkinson, Madison, IN (US)

(73) Assignee: Rotary Lift/A Dover Industries Company, Madison, IN (US)

( * ) Notice: Subject to any disclaimer, the term of this patent is extended or adjusted under 35 U.S.C. 154(b) by 1244 days.

(21) Appl. No.: 12/198,932

(22) Filed: Aug. 27, 2008

(65) Prior Publication Data

US 2010/0051884 A1 Mar. 4, 2010

(51) Int. Cl.
*B66F 7/28* (2006.01)

(52) U.S. Cl.
CPC ..... *B66F 7/28* (2013.01)
USPC ..... 187/219; 187/204; 187/218; 254/2 B; 254/45

(58) Field of Classification Search
CPC ..... B66F 7/28
USPC ..... 187/216, 217, 221, 204, 218, 219; 254/45, 2 C, 7 C, 8 C, 9 C
IPC ..... B66F 7/26, 7/28, 7/00, 7/12; B60S 9/04, B60S 9/10, 9/14
See application file for complete search history.

(56) References Cited

U.S. PATENT DOCUMENTS

| | | | |
|---|---|---|---|
| 2,231,362 A | 2/1941 | Kroll | |
| 2,285,989 A | 6/1942 | Kroll | |
| 2,612,344 A | 9/1952 | Thompson | |
| 2,769,508 A | 11/1956 | Pelouch | |

(Continued)

FOREIGN PATENT DOCUMENTS

| | | | | |
|---|---|---|---|---|
| DE | 93 00 989.5 | | 5/1993 | |
| FR | 2699876 | A1 * | 7/1994 | ..... B60S 13/02 |
| JP | 2001130713 | A * | 5/2001 | ..... B66F 7/28 |
| WO | WO 2008031386 | A1 * | 3/2008 | ..... B66F 7/28 |

OTHER PUBLICATIONS

Uni-Lift 2.30 XY, mit Herrmann, www.herrmann.de (Jan. 5, 2004) pp. 1-2.
Uni-Lift 2.35, mit Herrmann, www.herrmann.do (Jan. 5, 2004) pp. 1-2.
Uni-Lift 2.35 XY, mit Herrmann, www.herrmann.de (Jan. 5, 2004) pp. 1-2.

(Continued)

*Primary Examiner* — Michael Mansen
*Assistant Examiner* — Stefan Kruer
(74) *Attorney, Agent, or Firm* — Frost Brown Todd LLC

(57) ABSTRACT

A vehicle lift comprises a lifting mechanism configured to lift a vehicle for servicing, and at least one horizontal platform attached to a top of the lifting mechanism to engage with an underside of the vehicle. Adjustable slide members are movably attached to opposite ends of the horizontal platform and each are configured to move linearly in a horizontal path to align with the lifting points on the vehicle. Each slide member is both pivotally and slidingly engaged with the horizontal platform, and each slide member has a normally horizontal position. When the slide member is horizontal, the slide member is automatically constrained or locked to prevent linear movement of the slide member. When one end of the slide member is lifted to an angular position, the constraint is automatically disengaged and a linear slide bearing is engaged. When the slide member is in the angular position, the slide member can be easily adjusted via the bearings to match with a pick up point on an underside of a vehicle. Once the adjustment point has been reached, the slide member is returned to the horizontal position to automatically re-engage the constraint.

38 Claims, 6 Drawing Sheets

(56) References Cited

U.S. PATENT DOCUMENTS

| | | | | |
|---|---|---|---|---|
| 2,826,269 | A | 3/1958 | Harr | |
| 2,958,395 | A | 11/1960 | Wallace | |
| 3,713,515 | A | 1/1973 | Hott | |
| 4,491,201 | A * | 1/1985 | Mountz | 188/42 |
| 5,678,658 | A | 10/1997 | Wanner | |
| 6,622,636 | B2 | 9/2003 | Bonacini | |
| 2003/0035913 | A1 | 2/2003 | Shobert | |

OTHER PUBLICATIONS

Zweistempel-Hebebühne, Typ: JAB TwinRam 32 T/32 S/T, J.A. Becker & Söhne-Maschinenfabrik, www.jab-beckerde, pp. 1-2, Jan. 2, 2000.

Search Report dated Nov. 10, 2008 for Application No. PCT/US08/74423.

Written Opinion dated Nov. 10, 2008 for Application No. PCT/US08/74423.

* cited by examiner

INFINITELY ADJUSTABLE AND CONSTRAINABLE MOVABLE STRUCTURE FOR A VEHICLE LIFT

FIELD OF THE PRESENT ADJUSTABLE VEHICLE LIFT

The present vehicle lift relates, in general, to vehicle lifts, and more particularly to a vehicle lift with a horizontally adjustable pad structure to engage a pickup point on an undersurface of the vehicle, and a constraining device to secure the adjusted pad structure at any point in a horizontal range of motion.

BACKGROUND

Vehicle lifts are well known in the art for lifting a vehicle for service. Vehicles are constructed with vehicle lift points on an underbody of the vehicle. These lift points are structurally configured to support the weight of the vehicle, and should be used when lifting the vehicle to prevent damage. Due to the wide variety of vehicles with differing engine and suspension configurations, the lifting points can vary. For a vehicle lift to be acceptable for vehicle servicing, it must be configurable or adjustable to accommodate the different locations of the vehicle lift points. While many adjustable vehicle lifts are known, the adjustable portions can be heavy, can be cumbersome, can drag on the ground when the lift is in the lowest position, or can be difficult to adjust. This may discourage the operator from properly adjusting the vehicle lift to align with the lifting points.

In addition, it is desirable to lock or secure the adjustable portions of the vehicle lift once they are adjusted. The lock provides safety so that the adjustable portions don't move when the vehicle is lifted, and can secure a pre-adjusted lift in a desired configuration. Securing a lift in a pre-adjusted configuration enables the operator to perform the adjustments before the vehicle drives onto it, and maintains the adjustments as the vehicle is driven onto the lift. Many of these locks can suffer from a limited number of locking positions, have loose elements that can be lost (such as securing pins), can be difficult to use, and can require frequent manual intervention to lock and unlock (such as pin insertions and removals).

In some cases, the adjustment mechanisms and the lock mechanisms may be subjected to dirt and fluid contamination. The build up of contaminants on surfaces of a vehicle lift can decrease lift adjustment, decrease rotation of lift components, can make it difficult to lock components together, and can require frequent cleaning.

Consequently, a significant need exists for a vehicle lift that is easy to use, requires less force to adjust than is typical, can be adjusted to any point within a range of motion, automatically unlocks for adjustment, automatically locks at any desired adjustment position, and provides protection of the components.

BRIEF SUMMARY

The present vehicle lift overcomes the above-noted and other deficiencies of the prior art by providing a linearly adjustable pad structure that is easy to move throughout a linear range of movement and can be moved to, or constrained at, any point along a range of movement.

In one aspect of the vehicle lift, an adjustable lift for a vehicle is provided. The vehicle lift comprises a lift configured to move vertically up and down. An elongate horizontal platform is attached to the lift and has a first end and a second end generally equidistant from the lift. A slider member is movably attached to each end of the horizontal platform with each slider member movable towards or away from the lift along a horizontal linear path. Wherein the movable slider member is further configured to be moved to any point along the linear path that aligns the slider member with a pick up point on an underside of the vehicle. A slide bearing is located between each slider member and the horizontal platform. A constraint for each slider member is configured to arrest linear movement of the slider member at any point along the linear path. Wherein when the slider member is moved along the linear path, the slider member is disengaged from the constraint and slidingly engaged with the slide bearing. And when the slider member is stopped at any point along the linear path, the slider member is slidingly disengaged from the slide bearing and fully engaged with the constraint to prevent further linear movement of the slider member.

In another aspect of the vehicle lift, an adjustable lift for a vehicle comprises a lift configured to move vertically. An elongated horizontal platform is attached to a top of the lift and has a first end and a second end generally spaced equidistantly from the lift. A slider member is movably attached to each end of the horizontal platform and configured to move linearly towards and away from the lift through a horizontal range of motion to align the slider member with a pickup point on an underside of the vehicle. A rocker is provided for toggling the slider member between a sliding position and a locking position. Wherein when the slider member is toggled to the sliding position, the slider member changes from locking engagement to sliding engagement with the horizontal platform. And when the slider member is toggled to the locking position, the slider member changes from sliding engagement to locking engagement with the horizontal platform. Wherein the slider member can be moved between positions at any point along the horizontal range of motion.

These and other objects and advantages of the present vehicle lift shall be made apparent from the accompanying drawings and the description thereof.

BRIEF DESCRIPTION OF THE FIGURES

The accompanying drawings, which are incorporated in and constitute a part of this specification, illustrate embodiments of the vehicle lift, and, together with the general description of the vehicle lift given above, and the detailed description of the embodiments given below, serve to explain the principles of the present vehicle lift.

DETAILED DESCRIPTION

The following description of certain examples of the vehicle lift should not be used to limit the scope of the present vehicle lift. Other examples, features, aspects, embodiments, and advantages of the vehicle lift will become apparent to those skilled in the art from the following description, which is by way of illustration, one of the best modes contemplated for carrying out the vehicle lift. As will be realized, the vehicle lift is capable of other different and obvious aspects, all without departing from the spirit of the vehicle lift. Accordingly, the drawings and descriptions should be regarded as illustrative in nature and not restrictive.

Figure 1:
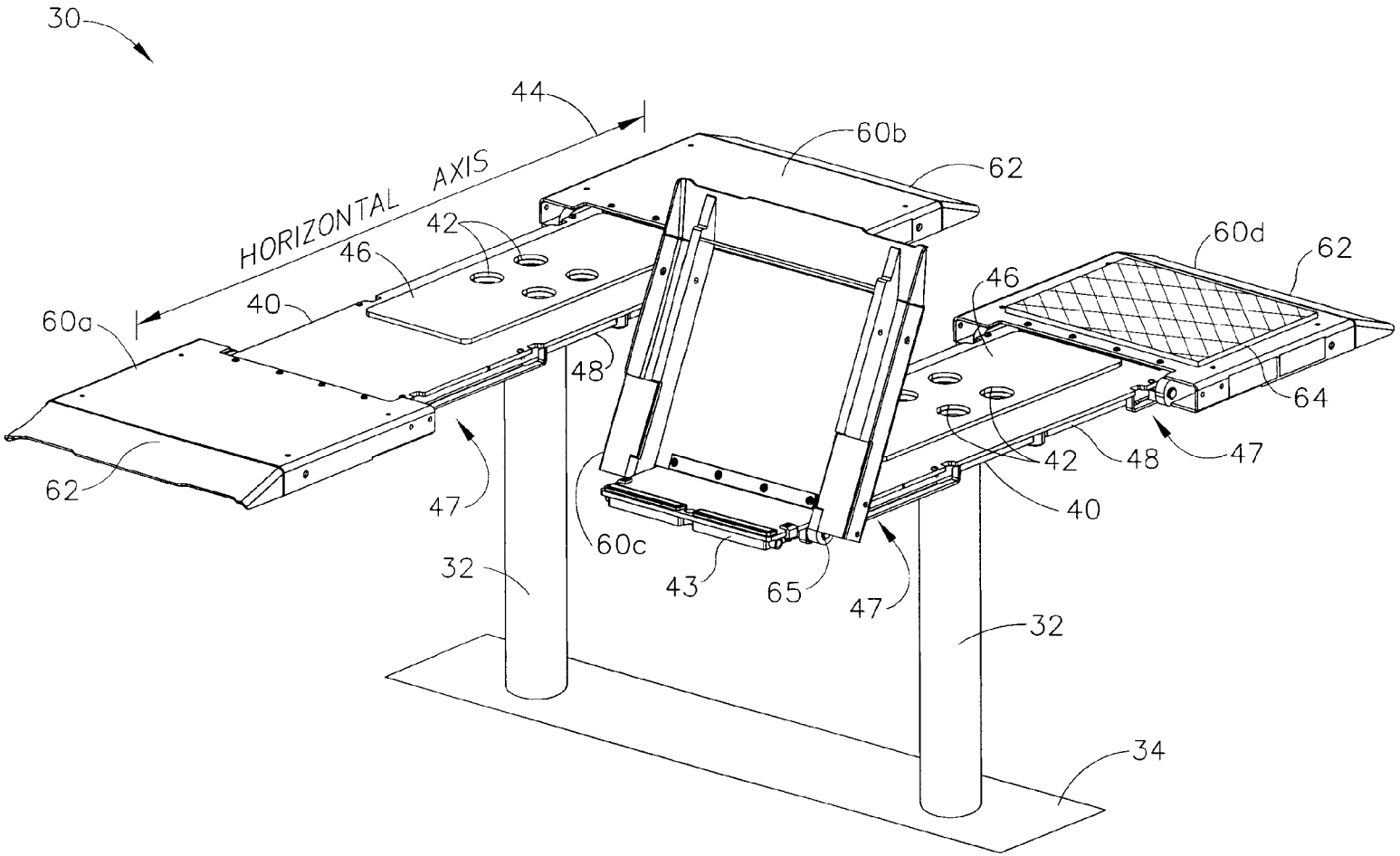
FIG. 1 is an isometric view of a vehicle lift constructed in accordance with teachings of the present vehicle lift with a carrier mounted to each lift and a slider slidably mounted on each end of each carrier with each slider horizontally adjustable to any point within a linear range of motion.

FIG. 1 shows a vehicle lift of a vehicle lift 30 in accordance with the teachings of the present vehicle lift for lifting a vehicle for service. Vehicle lift 30 can be configured to fit under a vehicle in a position between the front and rear wheels, (FIG. 2) and to move up and down in a vertical direction to engage with a pick up point or lifting point on an underside of the vehicle. Once the vehicle lift 30 contacts the lifting points, further upwards movement of the engaged vehicle lift 30 will lift the vehicle. As shown in FIG. 1, the vehicle lift 30 may be partially lifted or raised without the vehicle. Vehicle lift 30 can comprise at least one in-ground lift 32 configured to move up and down relative to a lift base plate 34 shown horizontally located at ground level. The in-ground lifts 32 can hydraulically actuated, or can use any other known lifting devices such as pneumatics, or other lifting mechanisms such as screws, cables, linkages, or any other form of lifting drive. A horizontal elongate platform 40 can be secured in a perpendicular orientation to the top of each lift 32 by a plurality of fasteners 42, and may move up and down as driven by the respective in-ground lift 32. The in-ground lifts 32 can be synchronized to move the platforms 40 up and down in unison.

Figure 2:
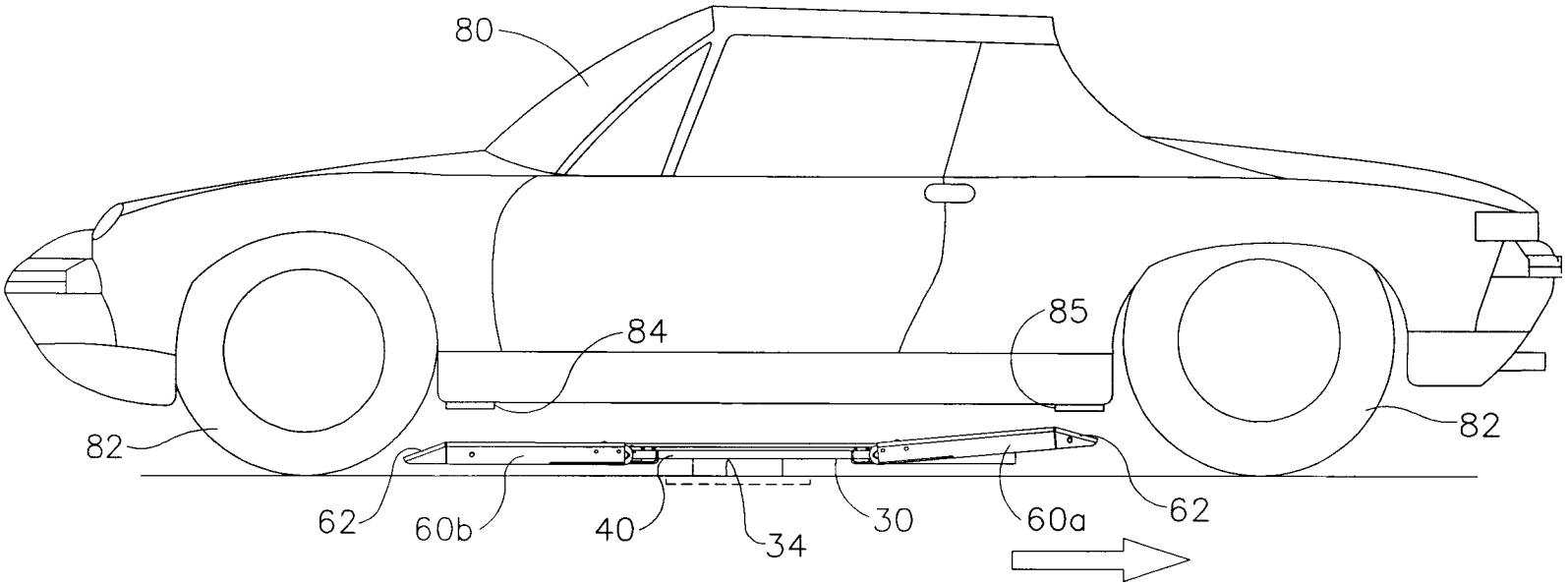
FIG. 2 is a side view of the vehicle lift of FIG. 1 with the lift on the ground and with a vehicle positioned above the lift, wherein one of sliders has been lifted to an angle and is ready for linear movement to a position under a vehicle lift point.

As shown in FIG. 1, each of the platforms 40 is generally an elongated member having a narrow horizontal width and a longer horizontal length and having ends 43 positioned at each end of the horizontal length in a vertical orientation. Each end 43 is located generally equidistant from the lift 32, and a horizontal longitudinal axis 44 extends between the ends 43 in the direction of the longer horizontal length. Each of the platforms 40 is vertically positioned at the same height, and each platform 40 has a longitudinal axis is in parallel alignment to the other. A top plate 46 is centrally attached to a top of each platform 40, and the top plate 46 extends equidistantly (in the horizontal direction) from the in-ground lifts 32. A slider or slide member 60 can be movably attached adjacent to the ends 43 of each of the platforms 40, and each slide member 60 can slide through a linear range (horizontally) to align with a respective pick up point on a vehicle. As shown in FIG. 1 and others, each of the slide members 60 are numbered as slide members 60*a*, 60*b*, 60*c*, and 60*d* for discussional purposes. With respect to the vehicle lift 30, each slide member 60 is configured to move horizontally towards or away from the respective in-ground lift 32 along the horizontal axis of the respective platform 40, and can be moved linearly to any point in a horizontal range of motion. When the vehicle lift 30 is dropped to the lowest point adjacent to the ground, the slide members 60 are configured to not interfere with the ground during operation (FIG. 2). This horizontal range of motion enables each slide member 60 to be individual adjusted, as required, to engage with a vehicle pick up point. In FIG. 1, the slide members 60*a*, 60*c* and 60*b* and 60*d* are shown at two different points of horizontal adjustment relative to the respective in-ground lifts 32. That is, the pair of slide members 60*b* and 60*d* are shown positioned longitudinally closer to the upwardly extending in-ground lift 32 than slide members 60*a* and 60*c*. Each slide member 60 can also be provided with a ramped or inclined end 62 so that a vehicle can drive up the inclined end 62 and onto (or over) the slide members 60 and the platforms 40. Slide members 60 have a normal horizontal orientation and each can be configured to individually pivot about at least one pin 65 so that the inclined end 62 can be raised as shown by raised slide member 60*c*. The pivoting slide members 60 can pivot to any point between the horizontal position of slide members 60*a*, 60*b*, and 60*d*, and the raised position shown by slide member 60*c*. Slide member 60*c* is shown in an over-center locked position wherein angled surface 62 of the slide member has pivoted over the center of pin 65. This over-center locked position has an advantage in that the horizontal footprint of the vehicle lift 30 is reduced to increase available service area when the lift is not being used. Thus, each slide member 60 can be configured to both pivot (about the end with the pin 65) and to slide longitudinally relative to the platforms 40 for adjustment. A pad 64 may be provided that attaches to a top of each of the slide members 60. The pads 64 can be configured to contact one or more pick up points on the undersurface of the vehicle, and can be constructed from a rigid material, a polymeric material, an elastomeric material, or a plastic material to prevent damage to the slide members 60 and the underside of the vehicle. Alternately, an upper surface of the slide member 60 (where pad 64 is shown) could be modified to include various types of finishes or textures such as but not limited to paints, powder coatings, rubberized dip coatings, non-skid surfaces, gritty surfaces, embossed or textured surfaces, or any other coatings or textures or features that could be added thereto. Such coatings or textures or features could be used on the slide member 60 or on pad 64 and could provide corrosion and wear protection, and/or additional features such as a non-skid surface.

FIG. 2 shows the vehicle lift 30 moved downward to the lowest position where the platform 40 and slide members 60 are adjacent to or touching the base plate 34 at ground level. When the vehicle lift 30 is in this position, a vehicle 80 can drive up the inclined ends 62 to straddle the vehicle lift 30 as shown. In this position, the vehicle lift 30 is located under the vehicle 80 and between the wheels 82 thereof. As shown, the leftmost slide member 60*b* has been positioned under a front pick-up point 84 on the undersurface of the vehicle 80, and a rightmost slide member 60*a* has the inclined end 62 lifted so that the slide 60*a* can be moved horizontally to the right (see arrow) to an adjustment position aligned with a second pickup point 85. When the lifted inclined end 62 is released or the slide member 60*a* is adjusted back to the horizontal, the slide member 60*a* automatically locks or is constrained (stopped)

relative to the vehicle lift 30. Note the slide members 60*a* and 60*b* are not constrained by ground contact.

Figure 3:
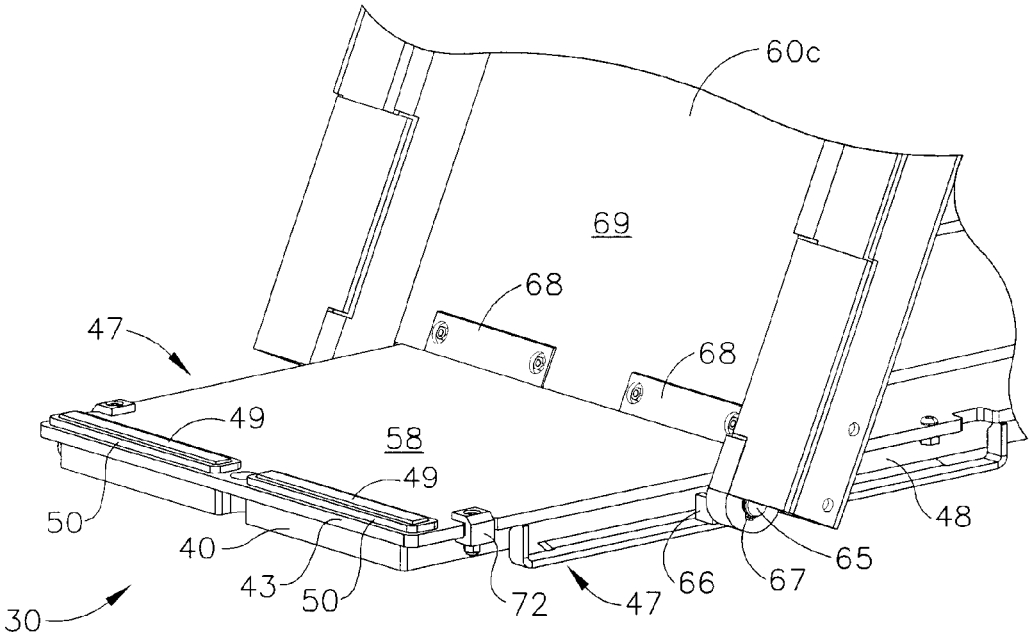
FIG. 3 is an isometric view of a raised slider of the vehicle lift of FIG. 1 showing the operative elements thereof.
Figure 4:
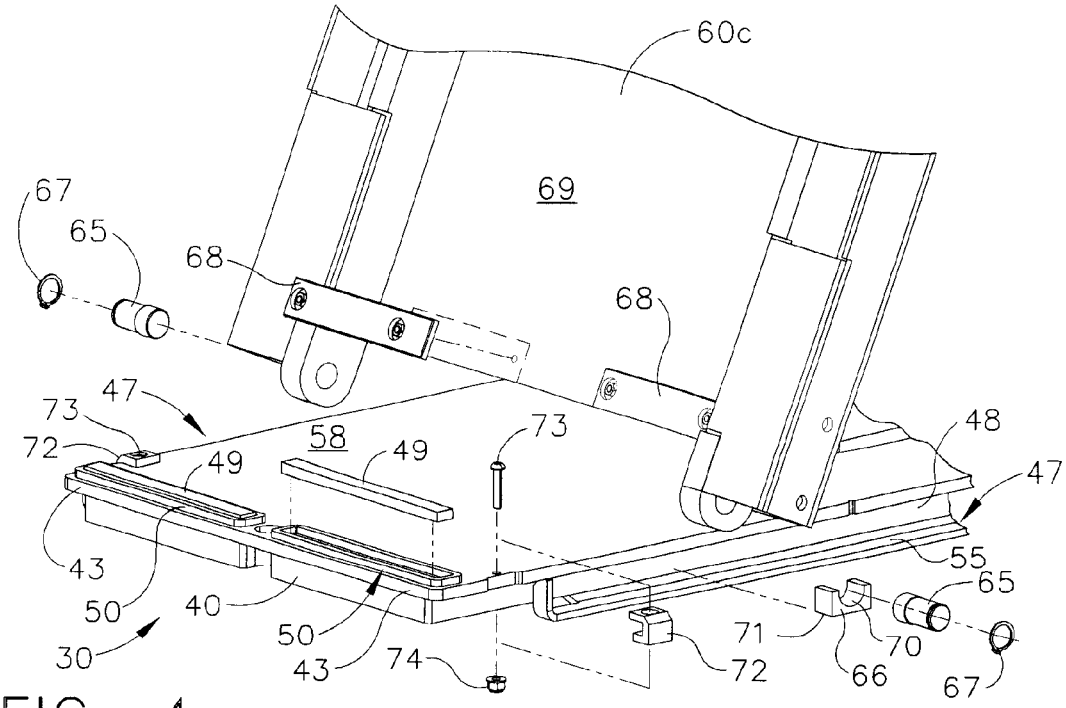
FIG. 4 is an isometric view of the raised slider of the vehicle lift of FIG. 3 shown partially exploded.

FIG. 3 shows a partial enlarged view of the lifted and pivoted slide member 60*c* of FIG. 1. FIG. 4 shows an exploded view of FIG. 3. As shown in FIG. 3, the slide member 60*c* straddles the platform 40 on either side, and is shown in the over-center angular position. Slide member 60*c* pivots around a pair of pins 65 that extend inwardly from each side of the slide member 60 and into frame or platform 40. Pins 65 can extend inwardly from the slide member 60*c* and into a pair of "U" shaped pivot blocks 66 slidably constrained in platform 40. Each of the "U" shaped pivot blocks 66 may slide horizontally along the range of motion within a respective horizontally extending channel 47 located on opposing vertical sides 48 of the platform 40, and blocks 66 can receive the pins 65 of a respective slide member 60 into the "U" or open slot 70 of the pivot block 66. Alternately, in another embodiment, the top of the "U" could be closed and the pivot block 66 would be a rectangular block with an enclosed slot 70*a* to receive the pin 65 therein (not shown).

Each platform 40 can have two inwardly opposing channels 47 on each vertical side about each end (FIGS. 3 and 4) for a total of four channels 47 per platform 40. The channels 47 are configured to slidingly receive the U" shaped pivot block 66 therein, and each of the pivot blocks 66 are configured to have a sliding surface 71 on a bottom thereof to slide on an upper side 55 of a respective channel 47. Thus, the pivot blocks 66 can enable each slide member 60 to both pivot around the pair of pins 65 received in the open slots 70, and to horizontally slide with the pivot blocks 66 through the channels 47. Each of the "U" shaped pivot blocks 66, in embodiments, can be constructed from a slick or lubricious material such as but not limited to UHMW polyethylene, Acetals such as Delrin®, PTFE (Teflon®) impregnated materials, or any other polymeric or plastic material that can be used as a bearing. Alternately, in some other embodiments, other bearing materials such as phenolics, laminates, ceramics, metals, non-lubricious plastics and the like can also be used. These materials, in embodiments, can be used singly or in combination, and with (or without) a lubricant.

Turning back to FIGS. 3 and 4, each channel 47 can be constructed in any manner such as a unitary machined out section, a stamping, or as an assembly of parts, such as but not limited to the welded assembly shown. The longitudinal movement of pivot blocks 66 within the channels 47 defines the range of horizontal motion available to the attached pivotable slide members 60, and provides infinite horizontal adjustment of the slide members 60 to any point within the horizontal range of motion. The pins 65 may be attached to the slide members 60 in any manner such as but not limited to adhesives, set screws, retaining rings, welding, or any other suitable method of attachment. One example of an embodiment of the attachment of the pin 65 is at least one retaining ring 67, shown for illustrative purposes only.

As shown in FIGS. 3 and 4, one or more of a rocker member 68 can be securely attached to an undersurface 69 of each slide member 60 in a position between the pins 65 and the inclined end 62. Rocker members 68 are configured to contact a surface 58 of the platform 40 when the slide members 60 are in the horizontal position, and the slide members 60 are further configured to rock about the rocker members 68 in this position. Rocker members 68 are shown as a strip with a rectangular profile, but other embodiments can be any other profile such as a round, a half round, a triangle, a square, or any other profile shape that performs as described.

The rocker members 68 can also be constructed of a slick or lubricious material such as those listed above. The rocker members 68, in embodiments, may provide sliding contact with or without lubricant and in any combination of materials. Rocker members 68 can possess sufficient rigidity to provide minimal or negligible deflection when loaded by the weight of a vehicle, and can repeatably slide on surface 58 of the platform 40 without damage, to either surface 58 or to rocker members 68. The rocker members 68 may be attached or fastened to the surface 69 in any manner such as but not limited to an adhesive, a rivet, a screw, a bolt and nut, or any other attachment or fastener that can adequately secure the rocker members 68 to the surface 69.

Each horizontally positioned slide member 60 can be automatically locked or constrained from horizontal movement relative to the vehicle lift 30 when the slide member 60 is stopped and moved to the horizontal position, and automatically unlocked or unconstrained for horizontal movement when the inclined end 62 is lifted. To lock or constrain the slide members 60 in the horizontal position, one or more reaction bars or constraint members 49 can be attached to the platform 40 to extend upwardly from the surface 58. The constraint members 49 may frictionally engage with the undersurface 69 of the horizontal slide members 60 to prevent horizontal movement of the slide members 60, and may disengage with the undersurface 69 when the slide members 60 are lifted to an angled position. When a respective horizontal slide member 60 is subjected to a horizontal load, such as a push by an operator or by contact with a wheel of a vehicle being driven over the lift, the frictional contact with the constraint members 49 with the undersurface 69 locks or constrains the slide members 60 from horizontal movement. The constraint members 49 are configured to constrain each horizontal slide member 60 by generating sufficient frictional force from the weight of the slide member 60 pushing down on the constraint members 49. When a vehicle drives up onto a slide member 60, the weight of the vehicle pushes down on the constraint members 49 with the weight of the vehicle and increases the frictional force. When the inclined end 62 of the slide member 60 is lifted, the undersurface 69 moves away from contact with the constraint members 49, and the slide member 60 is no longer constrained or prevented from horizontal movement. When the slide member 60 is stopped and released or rotated back to the horizontal position, the constraint members 49 re-engage with the undersurface 69 and constrain the released slide member 60. Thus, the constraint members 49 can lock or prevent horizontal movement of the horizontal slide members 60 when the vehicle lift 30 moves vertically, and can minimize movement of the slide members 60 when disturbed by an outside force or horizontal load.

In FIG. 1, three of the four slide members 60 are constrained in the horizontal position by contact of a respective constraint 49 with a respective undersurface 69. Turning back to FIGS. 3 and 4, one or more of a constraint structure 50 can be attached to surface 58 to help align and secure the constraint members 49 to the platform 40. Constraint members 49 can be secured to the platform 40 in any manner such as but not limited to an adhesive, a rivet, a bolt, or a gripping configuration of the constraint structure 50 such as swaging, or a "T" slot. In FIGS. 3 and 4, each constraint member 49 can be formed from an elastomeric material such as but not limited to polyester, polyurethane, a rubber (natural or synthetic) or any one of a number of materials. Suitable materials can be formed with a durometer between 30 Shore A to 120 Shore A. In one embodiment, the durometer of the constraint member 49 can be between 75-95 Shore A, and in yet another embodiment can be a durometer of 85 Shore A.

A pair of alignment guides 72 can be attached to platform 40 adjacent to the ends 43, and can be used to align an angled slide member 60 as it pivots downwardly towards the horizontal position. As shown, a fastener such as but not limited to a bolt 73 and a nut 74 may be used to secure the alignment guides 72 to the platform 40. Alignment guides 72 can be constructed from any of the bearing materials listed above, or from any other material that can function as a guide.

Figure 5:
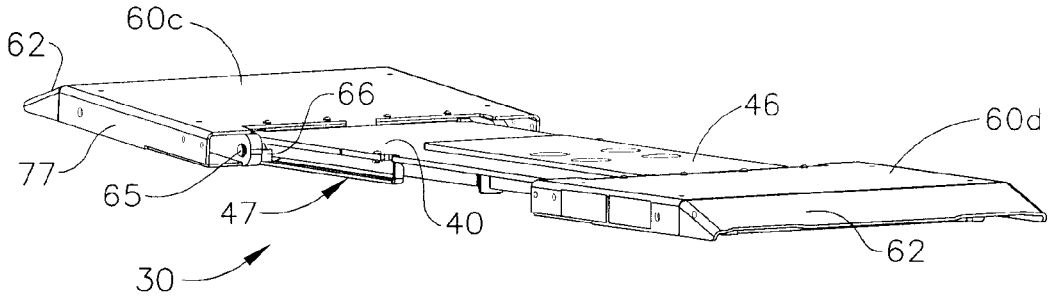
FIG. 5 is a partial isometric view of a portion of the vehicle lift of FIG. 1 with a slider raised to a position ready for linear movement.
Figure 6:
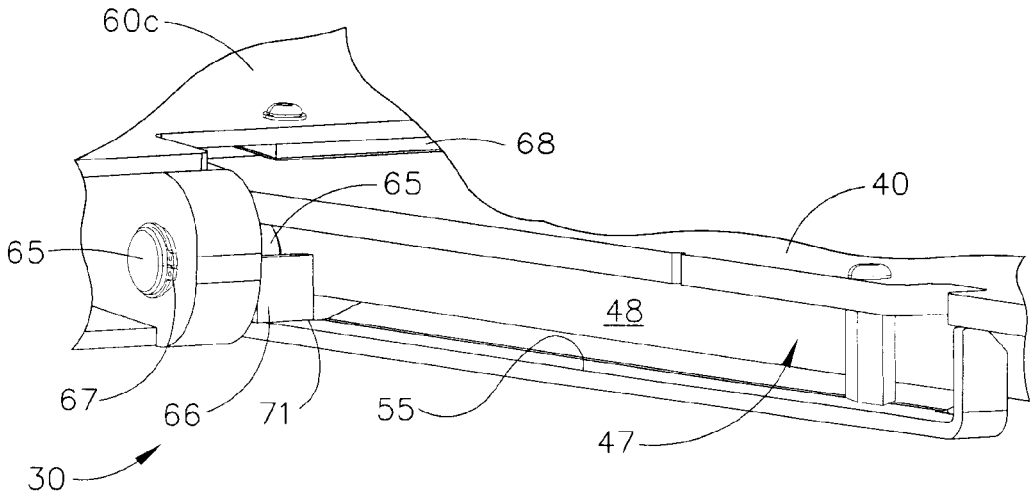
FIG. 6 is a partial isometric view of the vehicle lift of FIG. 5 with a pin joint portion magnified.

FIG. 5 is an isometric view showing the platform 40 with attached slide members 60*c* and 60*d* and FIG. 6 is an enlarged view of the pivot area of FIG. 5. In this view, one of the "U" shaped pivot blocks 66 can be seen within channel 47 and the inclined end 62 of the slide member 60*c* is rotated upwards. In FIG. 6, an enlarged view of the pin 65 in pivoting contact with the U" shaped pivot block 66 is shown. The pivoting of the slide member 60*c* has brought the pivot pin 65 into pivoting contact with the open slot 70 of the pivot blocks 66, and the weight of the raised slide member 60*c* has forced sliding surface 71 down into contact with the upwardly facing surface 55 of the channel 47.

Figure 7:
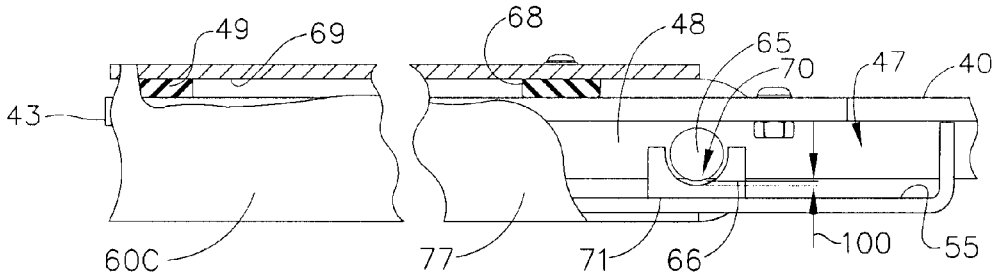
FIG. 7 is a partial side view of the vehicle lift of FIG. 1 with the slider in a locked horizontal position and with a portion of the exterior of the slider removed to show the engagement of the elements within.
Figure 8:
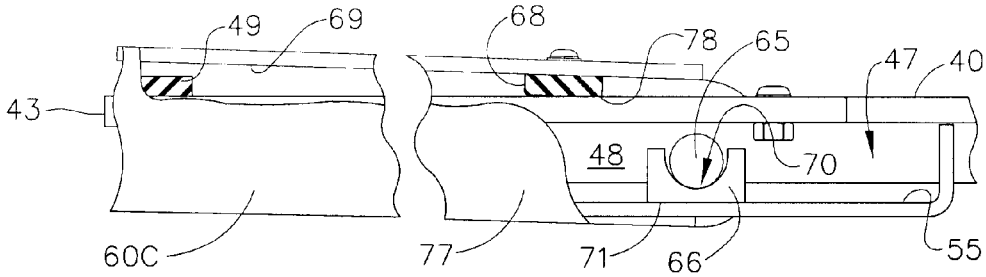
FIG. 8 is a partial side view of the vehicle lift of FIG. 7 with one end of the slider lifted to a first angular position to unlock the constraint preventing horizontal sliding movement of the slider and with portion of the exterior of the slider removed to show the engagement of the elements within.
Figure 9:
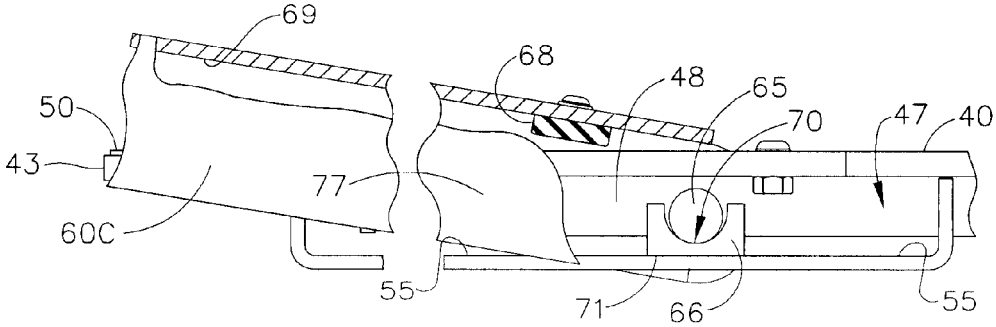
FIG. 9 a partial side view of the vehicle lift of FIG. 7 with one end of the slider lifted to a second angular position greater than the first angular position to allow movement of the slider, and with portion of the exterior of the slider removed to show the engagement of the elements within.

FIGS. 7-9 each show a partial side view of the slide member 60*c* and platform 40 at the pivot area. These views show a sequence of movements as the slide member 60*c* moves from a horizontal position of FIG. 7, to a first slightly pivoted position of FIG. 8, and to a second more pivoted position of FIG. 9. To show interaction of elements within, a portion of a side 77 of the slide member 60*c* has been removed for clarity. In FIG. 7, the slide member 60*c* is shown in the horizontal position and is held supported above platform 40 by the rocker members 68 attached to the slide member 60*c*, and constraint members 49 attached to the platform 40. The two lines of support (rocker members 68, constraint members 49) provide a large surface area to support all of the weight of the slide member 60*c*, as well as the weight of the lifted vehicle. The two lines of contact (rocker members 68 and constraint members 49) also hold the pin 65 upwardly away from contact with the open slot 70 within the pivot blocks 66. Thus, in FIG. 7, the pivot pin 65 is held above a base of the open slot 70 with a gap 100 therebetween, and no weight is passed to the pivot blocks 66. The slide member 60*c* and attached pins 65 are constrained from linear horizontal motion by friction with the constraint members 49, and the pivot blocks 66 are constrained from horizontal motion by pins 65. Pin 65 is also suspended within channel 47 with an air gap between an uppermost point on pin 65 and the channel 47, and with the gap 100 between a lowermost point on pin 65 and the pivot blocks 66. If a vehicle drives onto the slide member 60*c* or the lift 30 lifts the vehicle, the gap 100 remains between the pin 65 and pivot blocks 66, and the weight of the vehicle is not transmitted to the pivot blocks 66.

The slide members 60 may be further configured to act as a dirt or fluid shield, can be constructed without holes and can be configured to straddle and surround the platform 40. This could protect moving contact areas such as pivot blocks 66, rockers 68 and constraint members 49 from the ingress of dirt and fluids into the contact surfaces.

In FIG. 8, the inclined end 62 (not shown) has been lifted to pivot the slide member 60*c* slightly from the horizontal position. This action rocks the slide member 60*c* about a corner 78 of rocker members 68 that is in rocking contact with surface 58 of the platform. This rocking action moves the undersurface 69 of the slide member 60*c* away from contact with the constraint members 49, and moves the pins 65 into pivotal contact with the open slot 70 of the pivot blocks 66. The rocking action moves pins 65 downwardly in an arc, and into contact with the base of the open slot 70. The contact between pin 65 and open slot 70 can force sliding surface 71 of the pivot blocks 66 into sliding engagement with the upwardly facing surface 55 of the channel 47. By disengaging undersurface 69 from the constraint members 49, and engaging the pivot blocks 66, the slide member 60*c* may be capable of longitudinal movement along the horizontal path of motion by sliding on the lubricious pivot blocks 66. In the position of FIG. 8, the slightly tipped slide member 60*c* can be moved horizontally along the path of motion, and has sliding contact between the sliding surfaces 71 of the pivot blocks 66 moving on upwardly facing surfaces 55, and between the corner of the rocker members 68 sliding on surface 58 of the platform 40. This minimal angle of release enables sliding movement of the slide members 60 and can be advantageous when adjusting sliding members 60 under a low slung vehicle with minimal ground clearance.

In FIG. 9, the inclined end 62 of the slide member 60*c* has been lifted farther upwards from the position of FIG. 8. This further rotational or tilting movement of the slide member 60*c* can lift the rocker members 68 from contact with the surface 58 of the platform 40, and the slide member 60*c* may be solely in sliding contact with the platform 40 via the lubricious pivot blocks 66. This sliding contact could enable the slide member 60*c* to be more easily moved to any point along the range of motion. When the slide member 60*c* is adjusted to a desired point under a vehicle pick-up point, the slide member 60*c* can be rotated back down to the horizontal position shown in FIG. 7 to lockingly re-engage the constraint 49 with the slide member 60*c*. Thus, the vehicle lift 40 of the present vehicle lift provides automatic unlocking by lifting or rotating the slide members 60, and once unlocked, the slide members 60 are easily movable on linear slide bearings or blocks 66 that are engaged by the lifting process. The vehicle lift 40 of the present vehicle lift also provides automatic locking when a lifted slide member 60 is rotated back to the horizontal position. Thus, the slide members 60 are infinitely movable to an infinite number of points between the limits of the horizontal range of motion, and automatically lockable at an infinite number of points along the horizontal range of motion. By providing the lubricious pivot blocks 66 as sliding contact points with the platform 40, the force needed to move the slide members 60 in a linear path can be greatly reduced from currently available products. Thus, the operator of the vehicle lift may be provided with an automatically locking, easy to adjust, low angle of adjustment, and minimal adjustment force vehicle lift.

Figure 10:
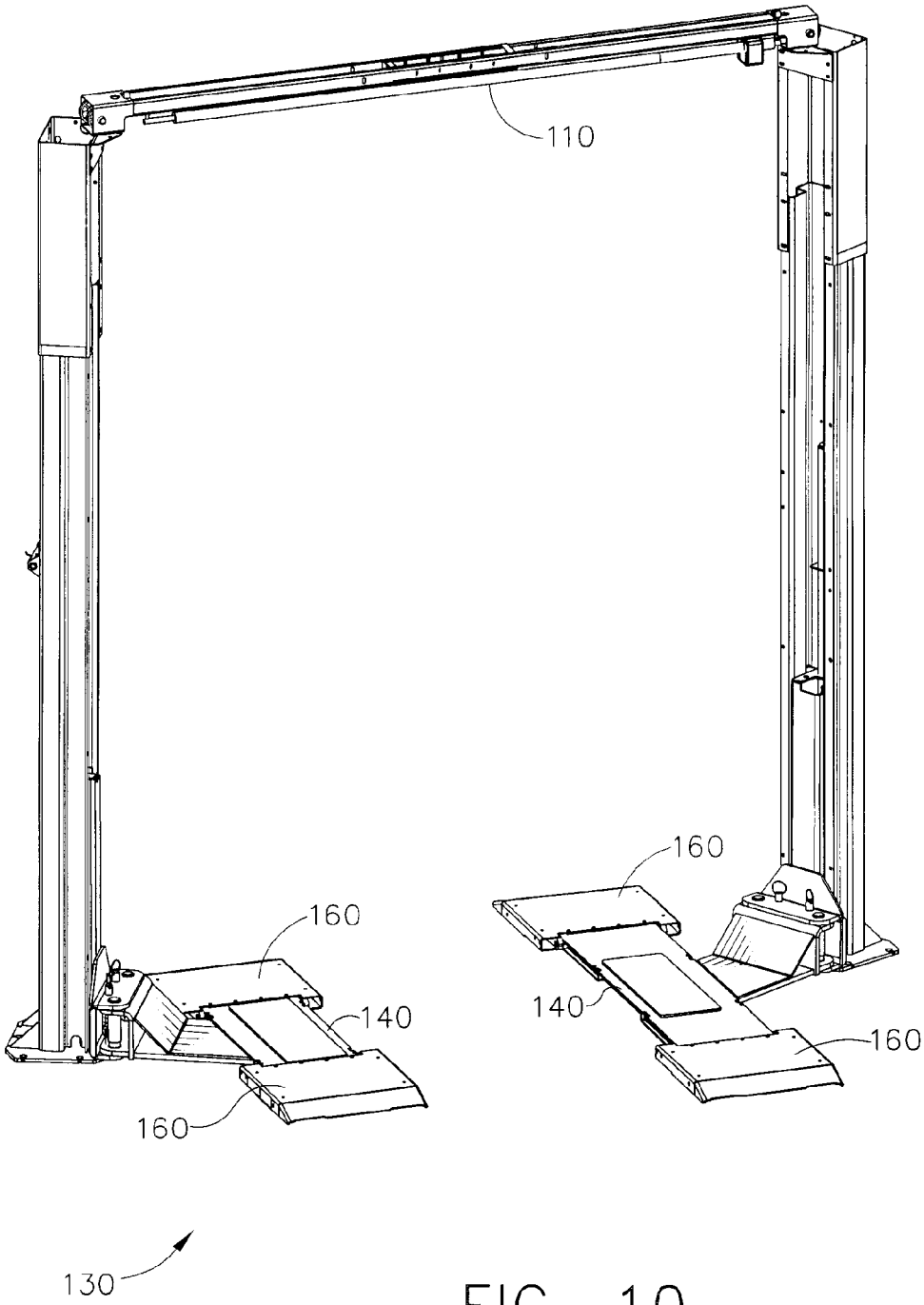
FIG. 10 is an isometric view of an above ground vehicle lift.

FIG. 10 is an alternate embodiment of the present invention showing an above ground vehicle lift 130 with a platform 140 and slide members 160 attached to an above ground lift apparatus 110. Such a lift apparatus can use a screw, cables, hydraulics, pneumatics or any one of a number of known lifting mechanisms to raise and lower the platforms 140. The slide members 160 and platform 140 of this embodiment can be identical in design and operation to the embodiments of the slide members 60 and platform 40 described above, For embodiments shown in FIGS. 1-9, the rocker members 68 are shown attached to the undersurface 69 and the constraint members 49 are shown attached to the surface 58. In alternate embodiments, the rocker members 68 and constraint members 49 can swap attachment surfaces, or both can be attached to one of the surfaces. In any of the original or alternate embodiments, the lift 30 or lift 130 can still perform as described above.

In yet another alternate embodiment, the slide members 60 could be further configured to move laterally to the horizontal axis in a horizontal side-to-side movement. This side-to side movement can be in place of or in addition to the horizontal fore-and-aft (towards and away from the lift 32) movement previously described. This side-to-side motion could be accomplished by replacing the pad 64 shown in FIG. 1 with a laterally moveable pad assembly 164 (not shown) configured to slide from side-to-side on top of the slide member 60. Pad assembly 164 could include a rigid structure or plate sufficient to support the weight of the vehicle when moved to a sideways position, and could include laterally oriented slots within the plate. A shoulder screw could be inserted into each laterally extending slot and bolted to the slide member 60 for lateral movement of the plate of pad assembly 164. As the pad assembly 164 moves laterally relative to the slide member 60, the shoulder screw moves within the length of the slot. The embodiment of the slidable plate and shoulder screw-in-slot arrangement (not shown) would allow lateral movement of the pad assembly 164 relative to the slide member 60 through a range of motion provided by the slots.

And, in another alternate embodiment, a stop pin can be provided to limit the degree of lift or tilt of the slide member 60. The pin can be added to fixedly extend inwardly from a side wall such as wall 77 of the slide member 60*c* (not shown). As the slide member 60*c* rotates up from the horizontal position to an angular position, the stop pin can move upwardly in an arcuate path with the slide member 60 and can contact some portion of the platform 40 to stop further angular movement of the slide member 60*c*. This contact between the stop pin and platform 40 may prevent additional rotational movement. Thus, the extra stop pin allows adequate rotational movement to allow adjustment, but prevents excessive rotational movement. The extra stop pin could be added to all slide members 60 and could be permanently or removably attached to the a wall such as wall 77.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While the present vehicle lift has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. An adjustable lift for a vehicle comprising:

a lift configured to move vertically up and down;

an elongate horizontal platform attached to the lift and having a first end and a second end;

at least one slider member movably attached to a respective one of said first and second ends of the horizontal platform, each said at least one slider member having a respective weight;

each said at least one slider member being movable towards or away from the lift along a horizontal linear path, wherein the movable slider member is further configured to be moved to any point along the linear path that aligns the slider member with a respective pick up point on an underside of the vehicle;

each said at least one slider member having at least one associated slide bearing associated therewith, the respective weight of each said at least one slider member being supported by the horizontal platform through said associated slide bearing when said at least one slider member is being moved; and a constraint for each said at least one slider member configured to arrest linear movement of the at least one slider member at any point along the linear path, wherein when the at least one slider member is oriented to be moved along the linear path, the slider member is disengaged from the constraint and engaged with and supported by the slide bearing, and when the slider member is oriented to be stopped at any point along the linear path, the slider member is disengaged from the slide bearing and fully engaged with the constraint to prevent further linear movement of the slider member.

2. The adjustable lift of claim 1 wherein the constraint arrests linear movement of the slider member with frictional engagement between the slider member and the constraint.

3. The adjustable lift of claim 2 wherein the constraint frictionally engages with an undersurface of the slider member.

4. The adjustable lift of claim 2 wherein the constraint is formed from an elastomer having a durometer between 75 Shore A and 95 Shore A.

5. The adjustable lift of claim 4 wherein the elastomer has a durometer of 95 Shore A.

6. The adjustable lift of claim 4 wherein the elastomer is polyurethane.

7. The adjustable lift of claim 1 wherein the slide bearing is formed from a lubricious material for sliding contact with the platform.

8. The adjustable lift of claim 7 wherein the slide bearing is formed from Ultra High Molecular Weight (UHMW) polyethylene.

9. The adjustable lift of claim 1 wherein the platform includes at least one slot for the slide bearing to move within, and a length of the linear path is a linear distance the slide bearing moves within the slot.

10. The adjustable lift of claim 9 wherein the slider member is further configured to pivot to an angle that is over-center from the pin.

11. The adjustable lift of claim 1 wherein the slider member has at least one pin to engage with the slide bearing.

12. The adjustable lift of claim 11 wherein when the slider member is moved to an angle relative to the horizontal platform, the at least one pin of the slider member is moved into pivotal engagement with the slide bearing, and when the slider member is horizontal, the pin of the slider member is pivotally disengaged from the slide bearing.

13. The adjustable lift of claim 1 wherein when the slider member is horizontal, the constraint engages with the slider member to arrest movement of the slider member along the linear path.

14. The adjustable lift of claim 1 wherein when the slider member is moved to an angle relative to the platform, the slider member is disengaged from the constraint.

15. The adjustable lift of claim 1 wherein the constraint is a pad.

16. The adjustable lift of claim 1 wherein when the slider member is at an angle relative to the horizontal platform, the weight of the slider member is supported by the slide bearing, and when the slider member is horizontal, the weight of the slider member is unsupported by the slide bearing.

17. The adjustable lift of claim 1 wherein when the lift is at a lowest point adjacent to the ground, the slider member is configured to move along the horizontal linear path without ground contact.

18. The adjustable lift of claim 1 wherein the platform and the slider member are configured to be driven over by the vehicle without substantially moving the horizontal slide member engaged with the constraint.

19. The adjustable lift of claim 1 wherein the lift is one of an in-ground lift or an above-ground lift.

20. An adjustable lift for a vehicle comprising:

a lift configured to move vertically;

an elongated horizontal platform attached to a top of the lift and having a first end and a second end;

at least one slider member movably attached to a respective one of said first and second ends of the horizontal platform and configured to move linearly on the horizontal platform towards and away from the lift through a horizontal range of motion to align the slider member with a respective pickup point on an underside of the vehicle, each said at least one slider member having a respective weight;

a constraint configured to frictionally engage with the slider member when the slider member is in a locking position to thereby lock the slider member to the horizontal platform; and a rocker wherein as the at least one slider member is lifted from said locking position to a sliding position, the weight of the slider member is initially supported by said rocker and then all of the weight is not supported by said rocker as said slider member changes from locking engagement to sliding engagement with the horizontal platform.

21. The adjustable lift of claim 20 wherein the locking position of the slider member is horizontal and the sliding position of the slider member is at an angle relative to the horizontal platform.

22. The adjustable lift of claim 21 wherein when the slider member is horizontal, the weight of the horizontal slider member is supported by both the rocker and the constraint.

23. The adjustable lift of claim 22 wherein when the slider member is horizontal and the vehicle is lifted by the vehicle lift, a weight of the vehicle is supported by the slider member and transmitted to the horizontal platform by the rocker and the constraints.

24. The adjustable lift of claim 23 wherein the constraint is constructed from an elastomer having a durometer of 90 Shore A, and a frictional engagement between each slider member and a respective constraint increases as the weight increases.

25. The adjustable lift of claim 21 wherein when a free end of the slider member is lifted to a first angular position, the weight of the slider member is disengaged from the constraint and the weight of the slider member is supported by the rocker.

26. The adjustable lift of claim 25 wherein when the slider member is lifted to a second angular position, the slider member is engaged with at least one linear slide bearing between the slider member and the horizontal platform, and the weight of the slider member is supported by both the at least one linear slide bearing and the rocker.

27. The adjustable lift of claim 26 wherein when the slider member is lifted to a third angular position, the slider member is disengaged from the rocker and the weight of the slider member is supported by the at least one linear slide bearing.

28. The adjustable lift of claim 27 wherein when the slider member is in the third angular position, the slider member is moveable relative to the platform.

29. The adjustable lift of claim 26 wherein the slide bearing is constructed from Ultra High Molecular Weight (UHMW) polyethylene.

30. The adjustable lift of claim 26 wherein when the slider member is in the second angular position, the slider member is moveable relative to the platform.

31. The adjustable lift of claim 30 wherein the rocker is constructed from a material that is lubricious to minimize friction between the rocker and the horizontal platform.

32. The adjustable lift of claim 31 wherein the rocker is constructed from Ultra High Molecular Weight (UHMW) polyethylene.

33. The adjustable lift of claim 20 wherein the rocker member is configured for rocking engagement with a horizontal surface of the platform.

34. The adjustable lift of claim 33 wherein the rocker member is further configured for sliding engagement with a horizontal surface of the platform.

35. The adjustable lift of claim 20 wherein the slider member moves in a rocking motion around a portion of the rocker when moved between the locked position and the unlocked position

36. The adjustable lift of claim 20 wherein the rocker has a corner and the rocker pivotally rocks on the corner when moved between positions.

37. The adjustable lift of claim 20 wherein the rocker member is attached to the slider member.

38. The adjustable lift of claim 21 wherein when the slider member is in the second position and moveable relative to the platform, the rocker and the at least one linear slide bearing frictionally engage with the horizontal platform.

* * * * *